US009142895B2

(12) United States Patent
Hardy et al.

(10) Patent No.: US 9,142,895 B2
(45) Date of Patent: Sep. 22, 2015

(54) COAXIAL CONNECTOR ASSEMBLY

(71) Applicant: Tyco Electronics Corporation, Berwyn, PA (US)

(72) Inventors: Douglas John Hardy, Middletown, PA (US); John Wesley Hall, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 48 days.

(21) Appl. No.: 14/182,096

(22) Filed: Feb. 17, 2014

(65) Prior Publication Data

US 2015/0236435 A1 Aug. 20, 2015

(51) Int. Cl.

| | |
|---|---|
| ***H01R 9/05*** | (2006.01) |
| ***H01R 24/40*** | (2011.01) |
| ***H01R 24/38*** | (2011.01) |
| *H01R 103/00* | (2006.01) |

(52) U.S. Cl.

CPC ..... *H01R 9/0518* (2013.01); *H01R 9/05* (2013.01); *H01R 24/38* (2013.01); *H01R 24/40* (2013.01); *H01R 2103/00* (2013.01)

(58) Field of Classification Search

CPC ..... H01R 24/38; H01R 9/05
USPC ..... 439/578, 579–585, 675, 856, 857, 851
See application file for complete search history.

(56) References Cited

U.S. PATENT DOCUMENTS

| | | | | |
|---|---|---|---|---|
| 5,938,487 | A * | 8/1999 | Henry et al. | 439/857 |
| 6,398,593 | B1 * | 6/2002 | Yeh | 439/723 |
| 6,592,403 | B2 * | 7/2003 | Kooiman | 439/578 |
| 7,845,992 | B2 * | 12/2010 | Glick et al. | 439/843 |
| 7,896,695 | B1 | 3/2011 | Huang | |
| 8,366,483 | B2 | 2/2013 | Hardy et al. | |
| 2009/0197479 | A1 | 8/2009 | Glick et al. | |
| 2011/0318960 | A1 * | 12/2011 | Koga | 439/585 |
| 2013/0157505 | A1 * | 6/2013 | Sykes et al. | 439/578 |

FOREIGN PATENT DOCUMENTS

EP 2 587 590 A1 5/2013

OTHER PUBLICATIONS

Drawing No. C-1438896, Socket Contact, Plug, SMB, Rev. D3, Mar. 28, 2013, 1pg, TE Connectivity.

International Search Report, International Application No. PCT/US2015/015522, International Filing Date, Feb. 12, 2015.

* cited by examiner

*Primary Examiner* — Neil Abrams
*Assistant Examiner* — Travis Chambers

(57) ABSTRACT

A coaxial connector assembly includes an outer housing holding an outer contact, a dielectric holder received in the outer contact, and a center contact received in the dielectric holder. The dielectric holder has a front and a cavity extending axially along the dielectric holder bounded by a cavity wall. The dielectric holder has an expansion slot formed in the cavity wall offset from, and proximate to, the front. The center contact has a socket at a mating end configured to receive a pin contact of a mating connector assembly. The center contact has deflectable beams at the mating end configured to deflect outward when mated with the pin contact. The center contact has flared tip ends at the distal ends of the beams. The flared tip ends are received in the expansion slot when the deflectable beams are deflected outward during mating with the pin contact.

20 Claims, 6 Drawing Sheets

COAXIAL CONNECTOR ASSEMBLY

BACKGROUND OF THE INVENTION

The subject matter herein relates generally to coaxial connector assemblies.

Radio frequency (RF) coaxial connector assemblies have been used for numerous applications including military applications and automotive applications, such as global positioning systems (GPS), antennas, radios, mobile phones, multimedia devices, and the like. The connector assemblies are typically coaxial cable connectors that are provided at the end of coaxial cables.

In order to standardize various types of connector assemblies, particularly the interfaces for such connector assemblies, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. Like jack keys can only be connected to like plug keyways in FAKRA connectors. Secure positioning and locking of connector housings is facilitated by way of a FAKRA defined catch on the jack housing and a cooperating latch on the plug housing.

The connector assemblies include a center contact and an outer contact that provides shielding for the center contact. The center contact is typically a socket that receives a pin contact. Conventional sockets do not allow for a large enough catch circle to reliably capture the pin contact. The pin contact may miss the catch circle and become wedged between the center contact and the dielectric holding the center contact. An unreliable electrical connection may occur in such situation and/or damage to the center contact and/or pin contact may occur.

A need remains for a coaxial connector assembly that may be manufactured in a cost effective and reliable manner. Additionally, a need remains for a coaxial connector assembly having a socket that reliably captures a pin contact during mating.

BRIEF DESCRIPTION OF THE INVENTION

In one embodiment, a coaxial connector assembly is provided including an outer housing holding an outer contact, a dielectric holder received in the outer contact, and a center contact received in the dielectric holder. The dielectric holder has a front and a cavity extending axially along the dielectric holder bounded by a cavity wall. The dielectric holder has an expansion slot formed in the cavity wall offset from, and proximate to, the front. The center contact has a socket at a mating end configured to receive a pin contact of a mating connector assembly. The center contact has deflectable beams at the mating end configured to deflect outward when mated with the pin contact. The center contact has flared tip ends at the distal ends of the beams. The flared tip ends are received in the expansion slot when the deflectable beams are deflected outward during mating with the pin contact.

Optionally, a guide wall may be positioned forward of the expansion slot. The guide wall may have a guide opening with chamfered lead-in surfaces for directing the pin contact into the cavity. An internal diameter of the socket at the flared tip ends may be wider than a diameter of the guide opening in the guide wall.

Optionally, the expansion slot may be positioned radially outward of the cavity. The expansion slot may widen the cavity to receive the flared tip ends when the deflectable beams are deflected outward during mating the pin contact. The expansion slot may be open through a side of the dielectric holder to an exterior of the dielectric holder. The flared tip ends may define a funnel into the socket. The dielectric holder may include two expansion slots and the center contact may include two deflectable beams with the flared tip ends thereof received in corresponding expansion slots.

Optionally, the deflectable beams may have mating interfaces reward of the flared tip ends. An internal diameter of the socket at the mating interfaces may be narrower than a catch circle of the socket at the flared tip ends. The cavity may have an internal cavity diameter. The flared tip ends may have a deflected tip diameter, when the deflected beams are deflected outward, that is wider than the internal cavity diameter. The flared tip ends may have an un-deflected tip diameter, when the deflected beams are un-deflected, that is narrower than the internal cavity diameter.

DETAILED DESCRIPTION OF THE INVENTION

Figure 1:
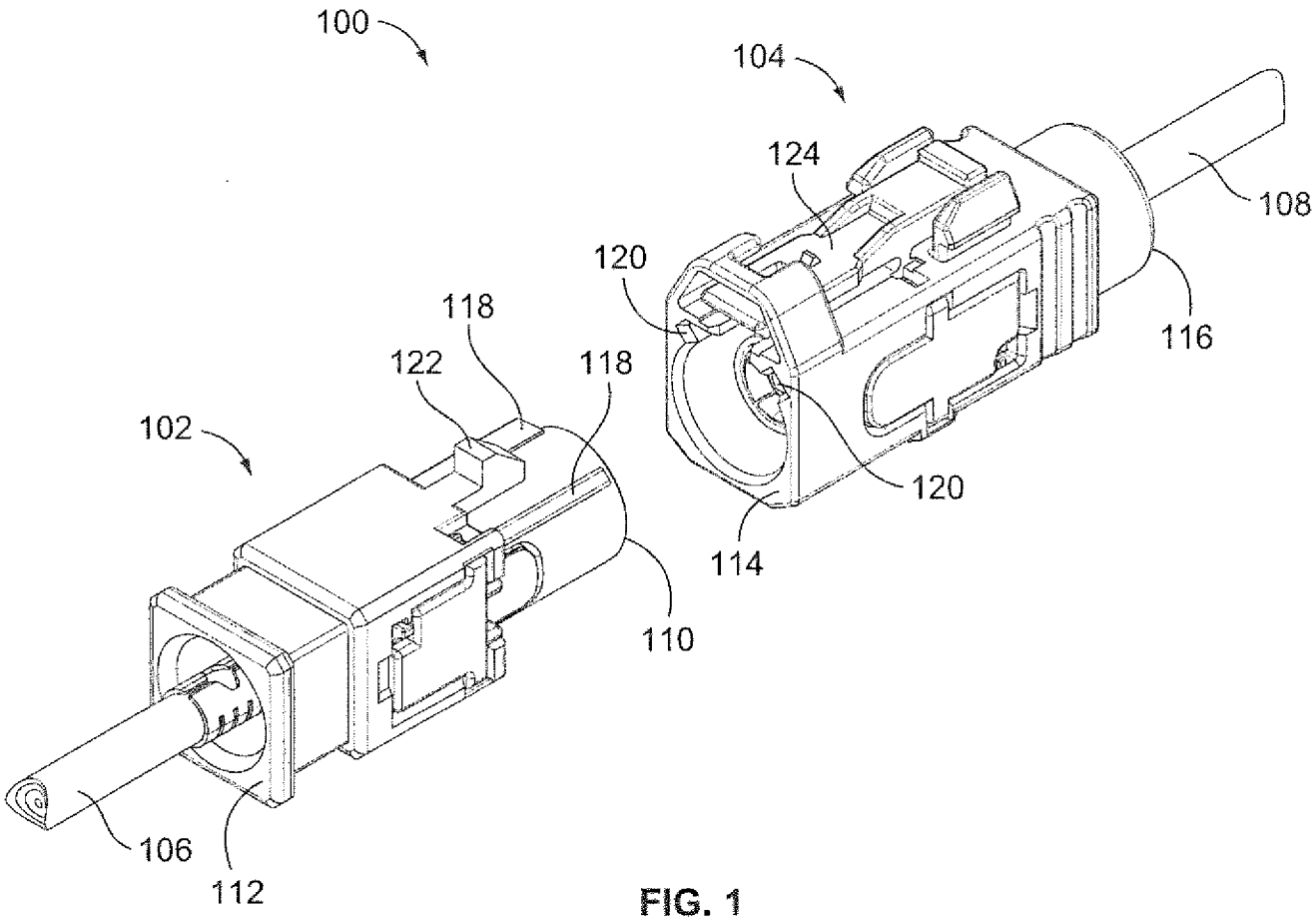
FIG. 1 illustrates a coaxial connector system including coaxial connector assemblies formed in accordance with an exemplary embodiment.

FIG. 1 illustrates a connector system 100 formed in accordance with an exemplary embodiment. The connector system 100 includes a first coaxial connector assembly 102 and a second coaxial connector assembly 104. In the illustrated embodiment, the first coaxial connector assembly 102 constitutes a jack assembly and may be referred to as a jack assembly 102. The second coaxial connector assembly 104 constitutes a plug assembly and may be referred to as a plug assembly 104. The jack assembly 102 and the plug assembly 104 are configured to be connected together to transmit electrical signals therebetween. The jack assembly 102 is terminated to a cable 106. The plug assembly 104 is terminated to a cable 108. In an exemplary embodiment, the cables 106, 108 are coaxial cables. Signals transmitted along the cables 106, 108 are transferred through the jack assembly 102 and plug assembly 104 when connected. The coaxial connector assemblies 102 and/or 104 may be terminated to a circuit board rather than a cable in alternative embodiments.

The jack assembly 102 has a mating end 110 and a cable end 112. The jack assembly 102 is terminated to the cable 106 at the cable end 112. In an exemplary embodiment, the jack assembly 102 has a center contact defined by a pin contact that is configured for mating with a center contact of the plug assembly 104. The plug assembly 104 has a mating end 114 and a cable end 116. The plug assembly 104 is terminated to the cable 108 at the cable end 116. During mating, the mating end 110 of the jack assembly 102 is plugged into the mating end 114 of the plug assembly 104.

In the illustrated embodiment, the jack assembly 102 and the plug assembly 104 constitute FAKRA connectors which are RF connectors that have an interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) that feature snap-on coupling and are designed to operate at either 50 Ohm or 75 Ohm impedances. The connector system 100 may utilize other types of connectors other than the FAKRA connectors described herein.

The jack assembly 102 has one or more keying features 118 and the plug assembly 104 has one or more keying features 120 that correspond with the keying features 118 of the jack assembly 102. In the illustrated embodiment, the keying features 118 are ribs and the keying features 120 are channels that receive the ribs. Any number of keying features may be provided, and the keying features may be part of the standardized design of the FAKRA connector.

The jack assembly 102 has a latching feature 122 and the plug assembly 104 has a latching feature 124. The latching feature 122 is defined by a catch and the latching feature 124 is defined by a latch that engages the catch to hold the jack assembly 102 and the plug assembly 104 mated together.

Figure 2:
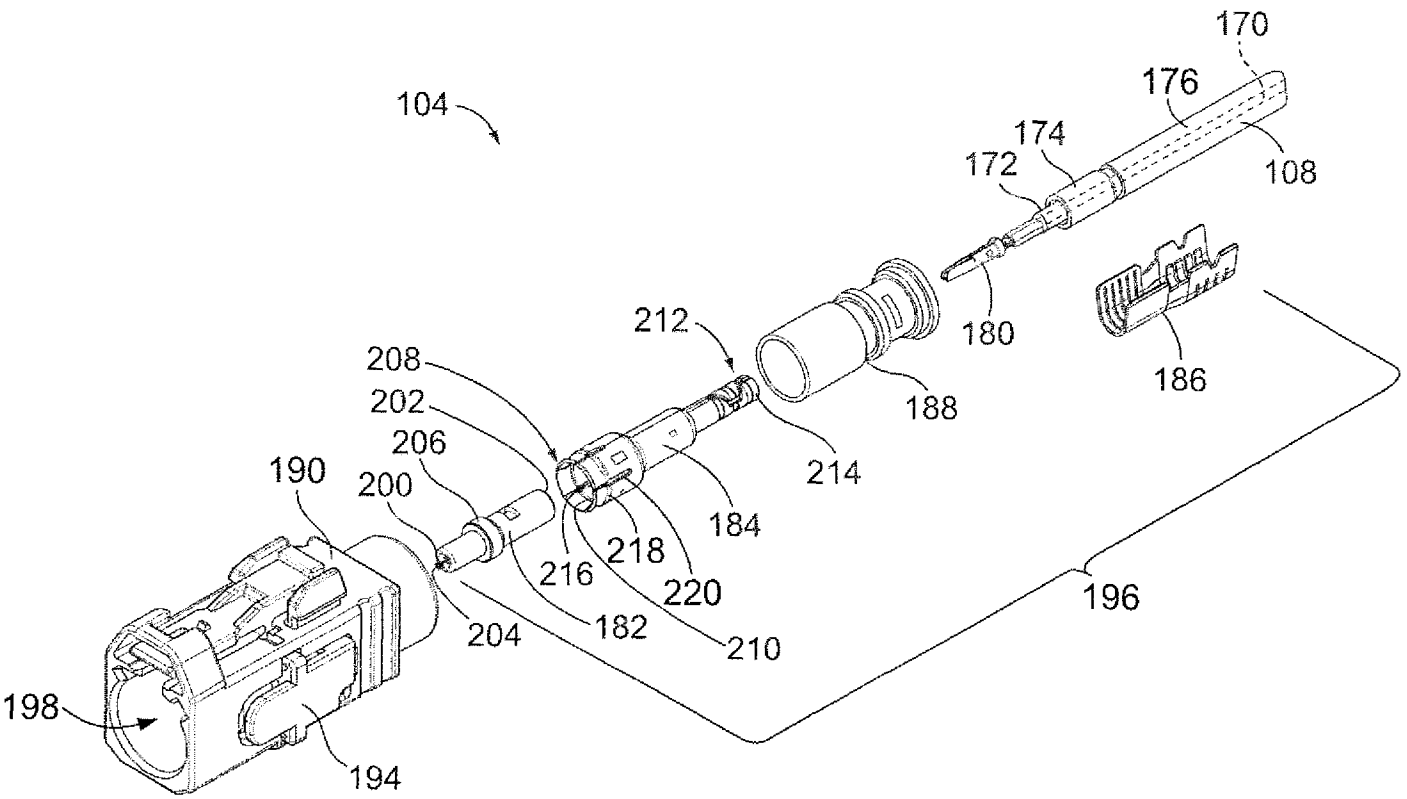
FIG. 2 is an exploded view of one of the coaxial connector assemblies shown in FIG. 1.

FIG. 2 is an exploded view of the plug assembly 104 and the cable 108. The cable 108 is a coaxial cable having a center conductor 170 surrounded by a dielectric 172. A cable braid 174 surrounds the dielectric 172. The cable braid 174 provides shielding for the center conductor 170 along the length of the cable 108. A cable jacket 176 surrounds the cable braid 174.

The plug assembly 104 includes a center contact 180, a dielectric holder 182, an outer contact 184, an outer ferrule 186, a cavity insert 188, and an outer housing 190. In the illustrated embodiment, the center contact 180 constitutes a socket contact; however other types of contacts are possible in alternative embodiments. The center contact 180 is terminated to the center conductor 170 of the cable 108. For example, the center contact 180 may be crimped to the center conductor 170.

The dielectric holder 182 receives and holds the center contact 180 and possibly a portion of the center conductor 170. The outer contact 184 receives the dielectric holder 182 therein. The outer contact 184 surrounds the dielectric holder 182 and at least a portion of the center contact 180. The outer contact 184 provides shielding for the center contact 180, such as from electromagnetic or radio frequency interference. The dielectric holder 182 electrically isolates the center contact 180 from the outer contact 184. The outer contact 184 is configured to be electrically connected to the cable braid 174.

The outer ferrule 186 is configured to be crimped to the cable 108. The outer ferrule 186 provides strain relief for the cable 108. In an exemplary embodiment, the outer ferrule 186 is configured to be crimped to the cable braid 174 and the cable jacket 176. For example, the outer ferrule 186 may be crimped to the cable braid 174 and the cable jacket 176 using an F-crimp or another type of crimp.

The cavity insert 188 surrounds at least a portion of the outer contact 184 and is axially secured with respect to the outer contact 184 to hold the outer contact 184 therein. The cavity insert 188 is received within the outer housing 190 and is held therein by a lock 194. The cavity insert 188 is used to hold the position of the outer contact 184 within the outer housing 190. The cavity insert 188 has an outer perimeter that is complementary in shape to a chamber in the outer housing 190. The complementary shapes hold the relative positions of the pieces. In an exemplary embodiment, the cavity insert 188 is a plastic molded part. Alternatively, the cavity insert may be a die-cast part or may be formed as part of the outer contact 184.

The center contact 180, dielectric holder 182, outer contact 184, outer ferrule 186, and cavity insert 188 define a plug subassembly 196 that is configured to be loaded into the outer housing 190 as a unit. Other components may also be part of the plug subassembly 196. The outer housing 190 includes a cavity 198 that receives the plug subassembly 196. The lock 194 holds plug subassembly 196 in the cavity 198.

The dielectric holder 182 extends between a front 200 and a rear 202. The dielectric holder 182 has a cavity 204 that receives the center contact 180. The dielectric holder 182 includes a flange 206 that extends radially outward therefrom. Optionally, the flange 206 may be approximately centrally located between the front 200 and the rear 202. The flange 206 is used to position the dielectric holder 182 within the outer contact 184.

The outer contact 184 has a mating end 208 at a front 210 thereof and a cable end 212 at a rear 214 thereof. The cable end 212 is configured to be terminated to the cable braid 174. The outer contact 184 has a cavity 216 extending between the front 210 and the rear 214. The outer contact 184 has a plurality of contact beams 218 at the mating end 208. The contact beams 218 are deflectable and are configured to be spring loaded against a corresponding outer contact (not shown) of the jack assembly 102 (shown in FIG. 1). The contact beams 218 are profiled to have an area of reduced diameter at the mating end 208 to ensure that the contact beams 218 engage the outer contact of the jack assembly 102. Each of the individual contact beams 218 are separately deflectable and exert a normal force on the outer contact to ensure engagement therewith. The contact beams 218 are separated by slots 220 extending between the contact beams 218. The slots 220 extend rearward from the front 210 of the outer contact 184.

Figure 3:
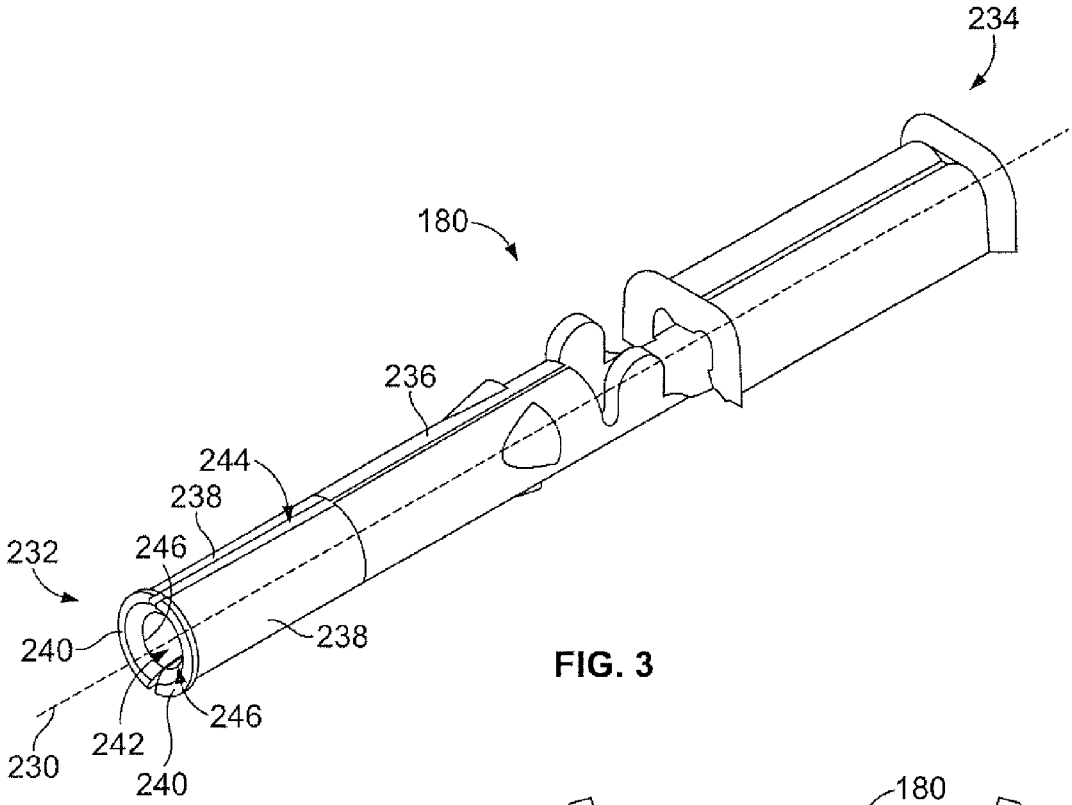
FIG. 3 is a front perspective view of a center contact of the coaxial connector assembly and formed in accordance with an exemplary embodiment.
Figure 4:
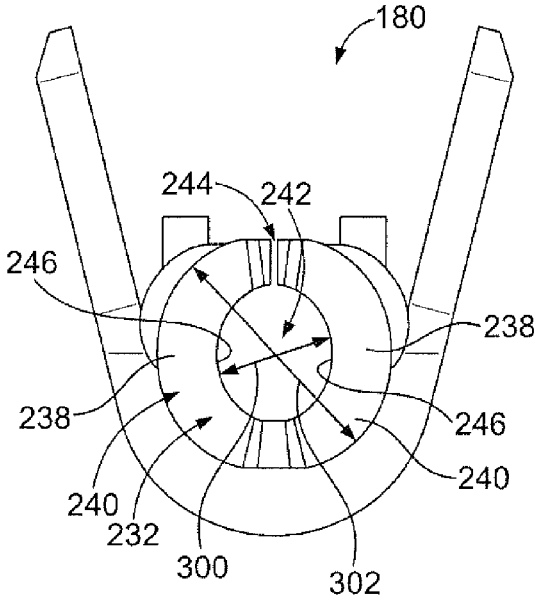
FIG. 4 is a front view of the center contact.

FIG. 3 is a front perspective view of the center contact 180 formed in accordance with an exemplary embodiment. FIG. 4 is a front view of the center contact 180. The center contact 180 extends along a longitudinal axis 230 between a mating end 232 at a front thereof and a cable end 234 at a rear thereof. The cable end 234 is configured to be terminated to the center conductor 170 of the cable 108 (both shown in FIG. 2). For example, the cable end 234 may have a crimp barrel (shown crimped in FIG. 3 and open in FIG. 4) that is configured to be crimped to the center conductor 170.

The center contact 180 includes a main body 236 forward of the crimp barrel. Deflectable beams 238 extend forward of the main body 236. The deflectable beams 238 have flared tip ends 240 at distal ends thereof. The main body 236 and deflectable beams 238 form a socket 242 at the mating end 232 that is configured to receive the pin contact of the mating connector assembly 102. Slots 244 are formed between the deflectable beams 238 to allow independent movement of the deflectable beams 238. In the illustrated embodiment, the center contact 180 includes two deflectable beams 238, however any number of deflectable beams 238 may be provided in alternative embodiments. The deflectable beams 238 are configured to be deflected outward when mated with the pin contact of the mating connecting assembly 102. For example, when the pin contact is received within the socket 242, the deflectable beams 238 are deflected outward and resiliently engage the pin contact to create an electrical connection between the center contact 180 and the pin contact.

The flared tip ends 240 define a tulip-shaped funnel into the socket 242. For example, the flared tip ends 240 are flared outward to provide lead-in into the socket 242. The deflectable beams 238 have mating interfaces 246 rearward of the flared tip ends 240. The mating interfaces 246 are configured to engage the pin contact when the pin contact is mated with the center contact 180. The center contact 180 has an internal diameter 300 (the shape of the center contact 180 at the mating interfaces 246 may or may not be circular; the shape of the center contact may be generally circular when the deflectable beams 238 are deflected outward and non-circular when the deflectable beams are un-deflected) at the mating interfaces 246.

The flared tip ends 240 define a catch circle that is larger than the tip of the pin contact to ensure that the center contact 180 catches the pin contact as the pin contact is loaded into the socket 242. The flared tip ends 240 have a catch circle diameter 302. The catch circle diameter 302 is larger than the internal diameter 300 at the mating interfaces 246. The flared tip ends 240 guide the pin contact to the mating interfaces 246. The catch circle diameter 302 increases as the pin is loaded into the socket 242 and the beams 238 are deflected outward. The funnel shaped mating end 232 accommodates for mis-alignment of the pin contact and reduces stubbing during mating of the pin contact with the center contact 180. The tulip shape defined by the flared tip ends 240 more easily receives the pin contact during mating of the pin contact with the center contact 180. Because the tip ends 240 are flared outward, the diameter of the center contact 180 at the mating end 232 is enlarged, which needs to be accounted for in the dielectric holder 182 (shown in FIG. 2).

Figure 5:
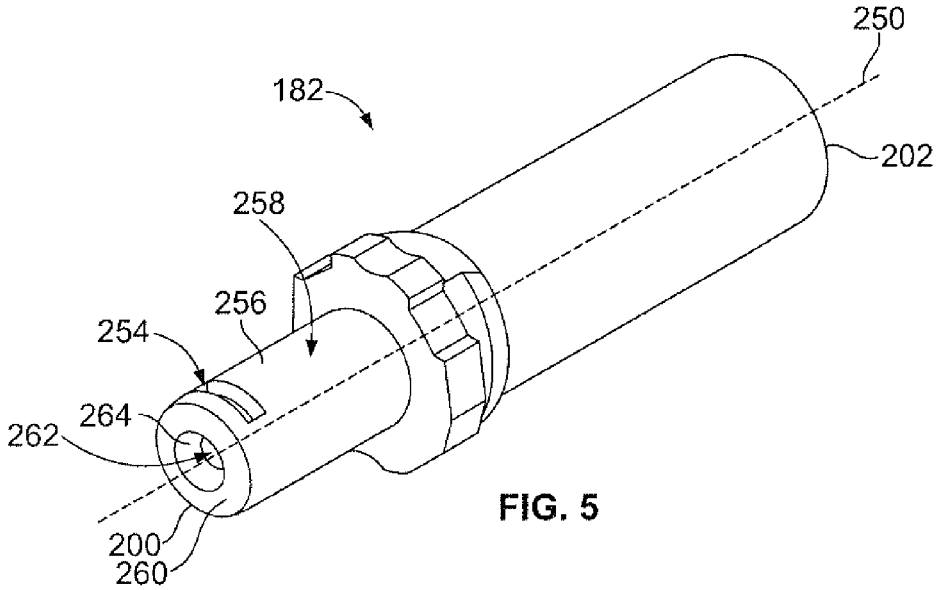
FIG. 5 is a front perspective view of a dielectric holder for the coaxial connector assembly and formed in accordance with an exemplary embodiment.
Figure 6:
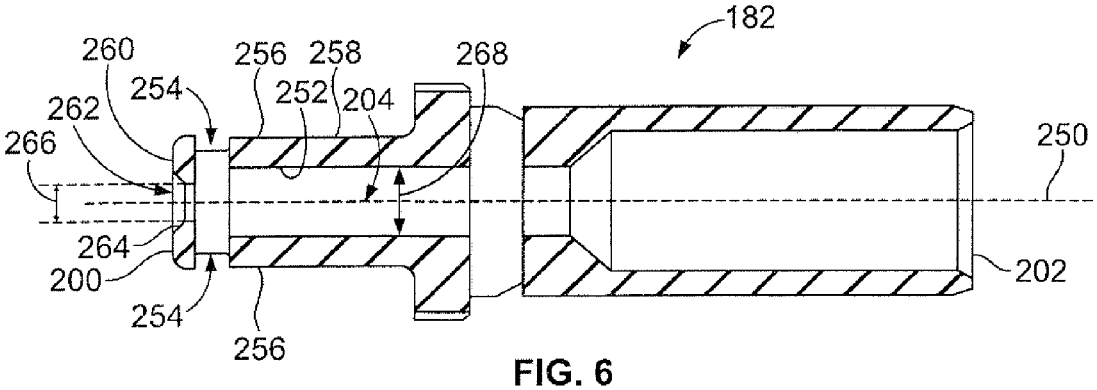
FIG. 6 is a cross sectional view of the dielectric holder.

FIG. 5 is a front perspective view of the dielectric holder 182 formed in accordance with an exemplary embodiment. FIG. 6 is a cross sectional view of the dielectric holder 182 formed in accordance with an exemplary embodiment. The dielectric holder 182 extends between the front 200 and rear 202. The cavity 204 extends along a central longitudinal axis 250 between the front 200 and the rear 202. The cavity 204 is defined by a cavity wall 252 along an interior of the dielectric holder 182. The cavity 204 is sized and shaped to receive the center contact 180 (shown in FIG. 3).

In an exemplary embodiment, the dielectric holder 182 includes an expansion slot 254 formed in the cavity wall 252 offset from, and proximate to, the front 200. The expansion slot 254 defines a space or area that is sized and shaped to receive the flared tip ends 240 (shown in FIG. 3) of the center contact 180 when the center contact 180 is mated with the pin contact. The expansion slot 254 forms part of the cavity 204. The expansion slot 254 is position radially outward of the main portion of the cavity 204. The expansion slot 254 widens or increases the size of the cavity 204 to receive the flared tip ends 240 when the flared tip ends 240 are deflected outward during mating with the pin contact.

Optionally, the expansion slot 254 may be open through a side 256 of the dielectric holder 182 to an exterior 258 of the dielectric holder 182. Optionally, the expansion slot 254 may be open at more than one side 256 of the dielectric holder 182. Alternatively, the expansion slot 254 may not be open through the dielectric holder 182, but rather is merely a pocket or chamber contained within the interior of the dielectric holder 182. Optionally, the expansion slot 254 may extend entirely circumferentially around the cavity 204. Alternatively, discrete expansion slots 254 may be provided that extend radially outward from different portions of the cavity 204. In the illustrated embodiment, as shown in FIG. 6, the dielectric holder 182 includes two expansion slots 254 on opposite sides 256 of the dielectric holder 182.

In an exemplary embodiment, the dielectric holder 182 includes a guide wall 260 at the front 200. The guide wall 260 is positioned forward of the expansion slot 254. The guide wall 260 includes a guide opening 262 at the front of the cavity 204. The guide opening 262 may define the front of the cavity 204. The pin contact is loaded into the cavity 204 through the guide opening 262. In an exemplary embodiment, the guide opening 262 includes chamfered lead-in surfaces 264 that guide the pin contact into the cavity 204. The guide opening 262 may be aligned with the longitudinal axis 250 to direct the pin contact along the central longitudinal axis 250 for mating with the center contact 180. Optionally, the guide opening 262 may have a smaller diameter 266 than an internal cavity diameter 268 of the cavity 204 to align the pin contact with the center contact 180 and to reduce stubbing.

Figure 7:
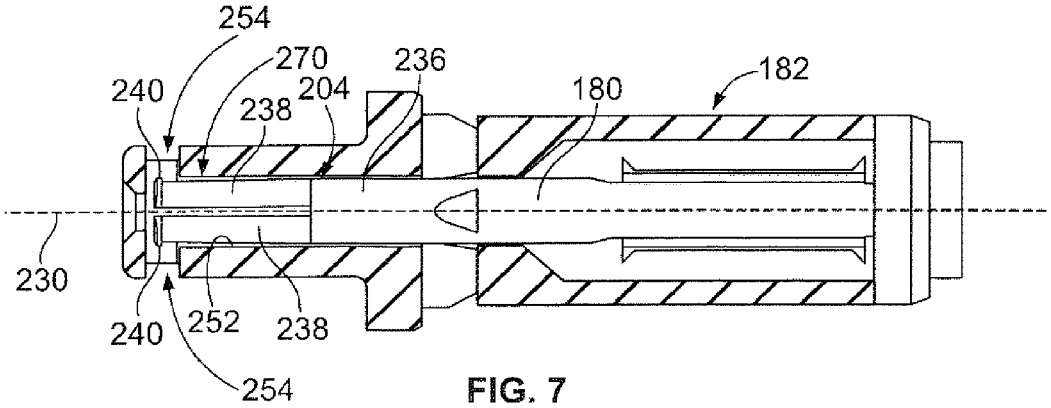
FIG. 7 is a cross-sectional view of the dielectric holder with the center contact loaded into the dielectric holder.

FIG. 7 is a partial sectional view of the dielectric holder 182 with the center contact 180 loaded into the dielectric holder 182. The center contact 180 is positioned in the cavity 204 such that the flared tip ends 240 are aligned with the expansion slots 254. The deflectable beams 238 are illustrated in an un-deflected state prior to the deflectable beams 238 being deflected outward by the pin contact. In the un-deflected state, the deflectable beams 238 are angled slightly inward toward the longitudinal axis 230 from the main body 236. The deflectable beams 238 are angled away from the cavity walls 252 such that gaps 270 exist between the exterior surfaces of the deflectable beams 238 and the cavity walls 252. When the pin contact is mated with the center contact 180, the deflectable beams 238 may be deflected outward into the gaps 270. The deflectable beams 238 may be deflected outward until the deflectable beams 238 engage the cavity walls 252. The flared tip ends 240 are received in the expansion slots 254 when the deflectable beams 238 are deflected outward.

Figure 8:
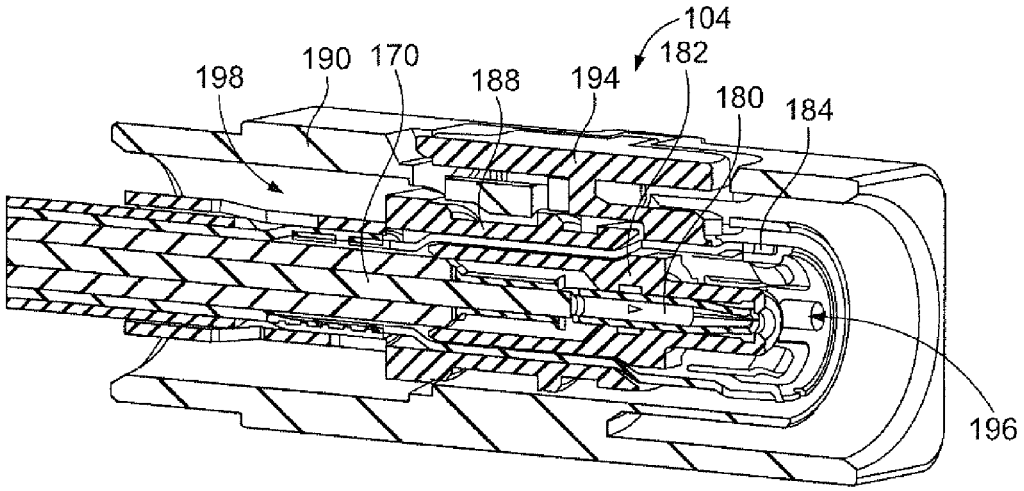
FIG. 8 is a partial sectional view of the coaxial connector assembly in an assembled state.

FIG. 8 is a partial sectional view of the coaxial connector assembly 104 in an assembled state. The center contact 180 is terminated to the center conductor 170 and is received in the dielectric holder 182. The outer contact 184 surrounds the dielectric holder 182 and provides shielding for the center contact 180. The cavity insert 188 supports the outer contact 184 in the outer housing 190. The lock 194 is used to secure the plug subassembly 196 in the cavity 198.

Figure 9:
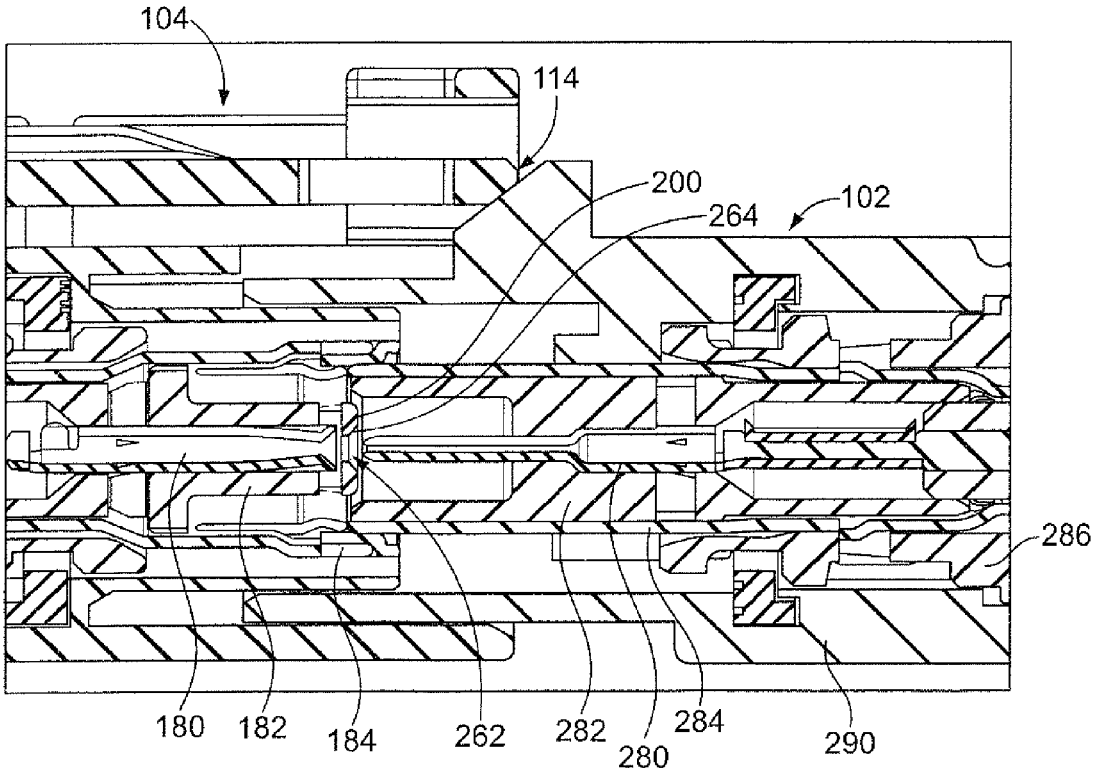
FIG. 9 is a cross sectional view of portions of the coaxial connector assemblies partially mated.

FIG. 9 is a cross sectional view of portions of the jack assembly 102 and the plug assembly 104 partially mated. The jack assembly 102 includes a center contact 280, a dielectric holder 282 and an outer contact 284 received in a cavity insert 286 that is received in an outer housing 290. In the illustrated embodiment, the center contact 280 constitutes a pin contact; however other types of contacts are possible in alternative embodiments. The center contact 280 may be referred to hereinafter as a pin contact 280.

During assembly, the outer housing 290 is loaded into the mating end 114 of the plug assembly 104. The outer contact 284 is received in the outer contact 184. The outer contact 184 generally aligns the pin contact 280 with the guide opening 262 and center contact 180. The lead-in surfaces 264 are used to force the pin contact 280 into alignment with the center contact 180. The front 200 of the dielectric holder 182 is configured to be loaded into a portion of the dielectric holder 282.

Figure 10:
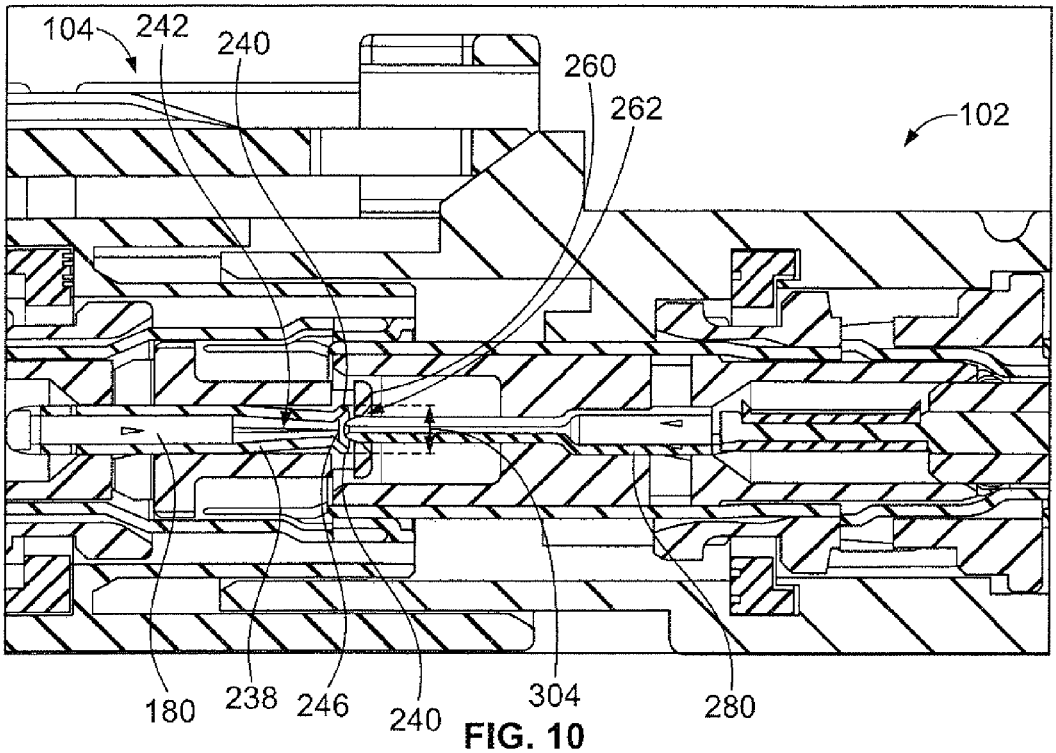
FIG. 10 is a cross sectional view of portions of the coaxial connector assemblies partially mated.

FIG. 10 is a cross sectional view of portions of the jack assembly 102 and the plug assembly 104 partially mated. The pin contact 280 is illustrated loaded through the guide opening 262 in the guide wall 260. The pin contact 280 is poised for mating with the center contact 180. The center contact 180 has an internal diameter 300 (shown in FIG. 4) at the mating interfaces 246 that is narrower than the diameter 266 (shown in FIG. 6) of the guide opening 262. The internal diameter 300 is smaller than a diameter of the pin contacts 280. The flared tip ends 240 are flared outward to define a funnel or catch circle that is larger or wider than the guide opening 262 to ensure that the pin contact 280 is directed into the socket 242 by the flared tip ends 240. The flared tip ends 240 have a catch circle diameter 302 (shown in FIG. 4) that is wider than the diameter 266 of the guide opening 262.

The deflectable beams 238 are angled downward toward the pin contact 280 such that the mating interfaces 246 are positioned to engage the pin contact 280. In the un-deflected state, the flared tip ends 240 are positioned within the cavity 204. The flared tip ends 240 have an un-deflected tip diameter 304 when the deflected beams 238 are un-deflected. The un-deflected tip diameter 304 is narrower than the internal cavity diameter 268 (shown in FIG. 6).

Figure 11:
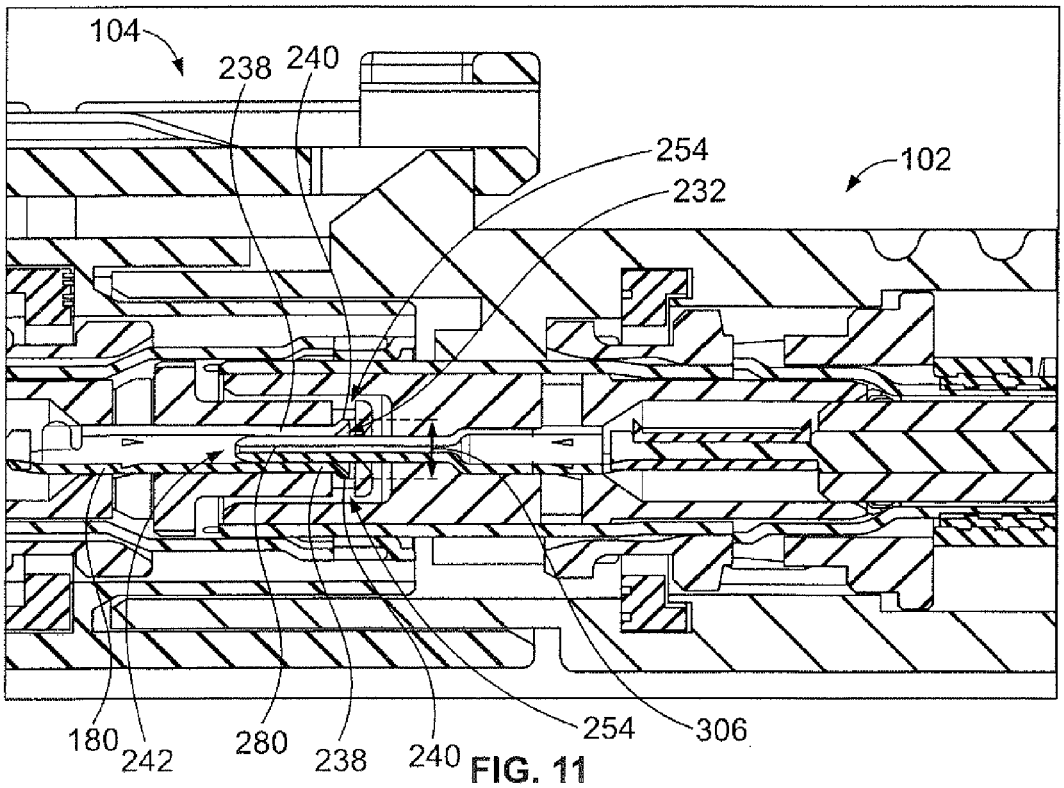
FIG. 11 is a cross sectional view of portions of the coaxial connector assemblies fully mated.

FIG. 11 is a cross sectional view of portions of the jack assembly 102 and the plug assembly 104 fully mated. The pin contact 280 is received in the socket 242 of the center contact 180. The deflectable beams 238 are deflected outward and are biased against and resiliently engage the pin contact 280 to ensure an electrical connection between the center contact 180 and the pin contact 280. When the deflectable beams 238 are deflected outward, the flared tip ends 240 are moved into the corresponding expansion slots 254. The flared tip ends 240 have a deflected tip diameter 306 when the deflectable beams 238 are deflected outward. The deflected tip diameter 306 is wider than the internal cavity diameter 268 (shown in FIG. 6). The expansion slots 254 accommodate the flared tip ends 240.

The dielectric holder 182 is thus able to accommodate the flared mating end 232 of the center contact 180. The flared mating end 232, defined by the flared tip ends 240, defines a larger catch circle for catching the pin contact 180. Providing the expansion slots 254 allows for the dielectric holder 182 to maintain the same outer dimensions as conventional dielectric holders that hold center contacts that do not have flared tip ends. The dielectric holder 182 remains within the FAKRA specifications as the dielectric holder 182 does not need to be made larger to accommodate the larger mating end 232 of the center contact 180. A more reliable connection is made between the jack assembly 102 and plug assembly 104 as the risk of mis-alignment or damage from stubbing to the mating end 232 is reduced, if not eliminated.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A coaxial connector assembly comprising:

an outer housing holding an outer contact;

a dielectric holder received in the outer contact, the dielectric holder having a front and a cavity extending axially along the dielectric holder, the cavity being bounded by a cavity wall, the dielectric holder having an expansion slot formed in the cavity wall offset from, and proximate to, the front; and a center contact received in the dielectric holder, the center contact having a socket at a mating end configured to receive a pin contact of a mating connector assembly, the center contact having deflectable beams at the mating end configured to deflect outward when mated with the pin contact, the center contact having flared tip ends at the distal ends of the beams, the flared tip ends being received in the expansion slot when the deflectable beams are deflected outward during mating with the pin contact.

2. The coaxial connector assembly of claim 1, wherein a guide wall is positioned forward of the expansion slot, the guide wall having a guide opening with chamfered lead-in surfaces for directing the pin contact into the cavity.

3. The coaxial connector assembly of claim 1, wherein the expansion slot is positioned radially outward of the cavity.

4. The coaxial connector assembly of claim 1, wherein the expansion slot widens the cavity to receive the flared tip ends when the deflectable beams are deflected outward during mating with the pin contact.

5. The coaxial connector assembly of claim 1, wherein the expansion slot is open through a side of the dielectric holder to an exterior of the dielectric holder.

6. The coaxial connector assembly of claim 1, wherein the flared tip ends define a funnel into the socket.

7. The coaxial connector assembly of claim 1, wherein the beams have mating interfaces reward of the flared tip ends, an internal diameter of the socket at the mating interfaces being narrower than a catch circle of the socket at the flared tip ends.

8. The coaxial connector assembly of claim 1, wherein the dielectric holder includes a guide wall positioned forward of the expansion slot, the guide wall having a guide opening for directing the pin contact into the cavity, an internal diameter of the socket at the flared tip ends being wider than a diameter of the guide opening in the guide wall.

9. The coaxial connector assembly of claim 1, wherein the dielectric holder include two expansion slots, the center contact including two deflectable beams with the flared tip ends thereof received in corresponding expansion slots.

10. The coaxial connector assembly of claim 1, wherein the cavity has an internal cavity diameter, the flared tip ends having a deflected tip diameter, when the deflectable beams are deflected outward, that is wider than the internal cavity diameter.

11. The coaxial connector assembly of claim 10, wherein the flared tip ends have an un-deflected tip diameter, when the deflectable beams are un-deflected, that is narrower than the internal cavity diameter.

12. A coaxial connector assembly comprising:

a coaxial cable having a center conductor, a dielectric surrounding the center conductor, a cable braid surrounding the dielectric and a jacket surrounding the cable braid;

an outer contact having a cable end terminated to the cable braid;

a dielectric holder received in the outer contact, the dielectric holder having a mating end and a cavity extending axially along the dielectric holder, the cavity being bounded by a cavity wall, the dielectric holder having an expansion slot formed in the cavity wall offset from, and proximate to, the mating end; and a center contact received in the dielectric holder, the center contact having a cable end terminated to the center conductor of the coaxial cable, the center contact having a mating end opposite the cable end, the mating end having a socket configured to receive a pin contact of a mating connector assembly, the center contact having deflectable beams at the mating end configured to deflect outward when mated with the pin contact, the center contact having flared tip ends at the distal ends of the beams, the flared tip ends being received in the expansion slot when the deflectable beams are deflected outward during mating with the pin contact.

13. The coaxial connector assembly of claim 12, wherein a guide wall is positioned forward of the expansion slot, the guide wall having a guide opening with chamfered lead-in surfaces for directing the pin contact into the cavity.

14. The coaxial connector assembly of claim 12, wherein the expansion slot is positioned radially outward of the cavity.

15. The coaxial connector assembly of claim 12, wherein the expansion slot widens the cavity to receive the flared tip ends when the deflectable beams are deflected outward during mating the pin contact.

16. The coaxial connector assembly of claim 12, wherein the expansion slot is open through a side of the dielectric holder to an exterior of the dielectric holder.

17. The coaxial connector assembly of claim 12, wherein the flared tip ends define a funnel into the socket.

18. The coaxial connector assembly of claim 12, wherein the beams have mating interfaces reward of the flared tip ends, an internal diameter of the socket at the mating interfaces being narrower than a catch circle of the socket at the flared tip ends.

19. The coaxial connector assembly of claim 12, wherein the cavity has an internal cavity diameter, the flared tip ends having a deflected tip diameter, when the deflectable beams are deflected outward, that is wider than the internal cavity diameter.

20. The coaxial connector assembly of claim 19, wherein the flared tip ends have an un-deflected tip diameter, when the deflectable beams are un-deflected, that is narrower than the internal cavity diameter.

* * * * *